United States Patent [19]

Whittaker et al.

[11] Patent Number: 4,829,338

[45] Date of Patent: May 9, 1989

[54] ELECTROPHOTOGRAPHIC DEVICE WITH IMPROVED BEAD PICKOFF ARRANGEMENT

[75] Inventors: Gary L. Whittaker, Covington, Pa.; Daniel M. Bray, Rochester, N.Y.

[73] Assignee: Xerox Corporation, Stamford, Conn.

[21] Appl. No.: 149,828

[22] Filed: Jan. 29, 1988

[51] Int. Cl.[4] ..... G03G 15/08

[52] U.S. Cl. ..... 355/305; 15/256.52; 118/652

[58] Field of Search ..... 355/3 R, 3 DD, 15; 15/256.52; 118/652; 430/125

[56] References Cited

U.S. PATENT DOCUMENTS

| | | | |
|---|---|---|---|
| 3,834,804 | 9/1974 | Bhagat et al. | 355/3 R |
| 3,894,513 | 7/1975 | Stanley et al. | 118/637 |
| 4,303,331 | 12/1981 | Thompson | 355/3 DD |
| 4,357,097 | 11/1982 | Koiso | 355/15 |
| 4,461,562 | 7/1984 | Goldfinch | 355/3 DD |
| 4,483,611 | 11/1984 | Matsuura et al. | 355/15 |
| 4,515,467 | 5/1985 | Suzuki | 355/15 |
| 4,557,582 | 12/1985 | Kan et al. | 355/3 DD |
| 4,558,294 | 12/1985 | Yamashita | 355/3 DD X |
| 4,571,071 | 2/1986 | Bothner | 355/15 |
| 4,592,653 | 6/1986 | Ikeda et al. | 355/3 DD |
| 4,609,280 | 9/1986 | Queener | 355/15 X |
| 4,705,383 | 11/1987 | Hiraga et al. | 355/3 DD |

FOREIGN PATENT DOCUMENTS

| | | |
|---|---|---|
| 2364563 | 7/1974 | Fed. Rep. of Germany . |
| 53-29724 | 3/1978 | Japan . |
| 56-133761 | 10/1981 | Japan . |

*Primary Examiner*—A. C. Prescott

*Attorney, Agent, or Firm*—Mark Costello

[57] ABSTRACT

A bead pickoff device for removal of carrier beads adhering to a charge retentive surface subsequent to development of an electrostatic latent image with a developer mix including toner and carrier beads. A stationary magnet member supported within a rotating non-magnetic shell includes a permanent magnet supported in a ferromagnetic strip is provided with first and second sides disposed at an angle in the range of 70° to 110° with respect to each other. The first long side is supported with angled surface free end adjacent the charge retentive surface. The stationary magnet is seated on the second side, spaced from the first. The magnetic field is concentrated in the space between the magnet and the first side to provide an increased bead pickoff force at the charge retentive surface, while the field is attenuated to reduce the force of attraction on the beads as they move away from the charge retentive surface.

20 Claims, 3 Drawing Sheets

ELECTROPHOTOGRAPHIC DEVICE WITH IMPROVED BEAD PICKOFF ARRANGEMENT

This invention relates to reproduction apparatus, and more particularly, to an electrophotographic device having a removal or pickoff device for removing carrier beads which adhere to a charge retentive surface in the apparatus during development.

INCORPORATION BY REFERENCE

The following are herein incorporated by reference: U.S. Pat. No. 3,894,513 to Stanley et al. and U.S. Pat. No. 3,834,804 to Bhagat et al.

BACKGROUND OF THE INVENTION

In electrophotographic applications such as xerography, a charge retentive surface is electrostatically charged, and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is well known, and useful for light lens copying from an original, and printing applications from electronically generated or stored originals, where a charged surface may be imagewise discharged in a variety of ways.

Developing material commonly used in systems for developing latent images on the charge retentive surface typically comprises a mixture of toner and a "carrier" of larger granular beads of a ferrous material. If the developing system is a magnetic brush assembly, magnetizable carrier beads also provide mechanical control for the formation of magnetic brush bristles so that toner can readily be brought into contact with the charge retentive surface. Toner is attracted to the latent image from the carrier beads to form the toner image. In this type of copier, some carrier beads inevitably adhere to the charge retentive surface after the image is developed. These adhering carrier beads prevent intimate contact between the substrate and toner image during the transfer step. It is thus essential for optimum operation that carrier beads remaining on the charge retentive surface be removed therefrom. Failure to remove carrier beads from the charge retentive surface results in a characteristic copy quality defect displaying a white area with a black dot in the center. The hard carrier beads also have a tendency to abrade and damage the charge retentive surface if not removed prior to reaching the cleaning zone.

Carrier bead removal devices are known, such as for example, U.S. Pat. No. 3,894,513 to Stanley et al. and U.S. Pat. No. 3,834,804 to Bhagat et al., which use a stationary magnet having a cylindrical shell rotating thereabout to remove the ferrous carrier beads from the photoreceptor for deposit in a sump or for return to the developer housing. A primary problem, however, is the need to increase the removal force on the beads without simultaneously increasing the magnetic force holding toner on the shell at the removal or drop off point. In the Xerox 1075 copier, a short piece of magnet was arranged with a polarization opposite to that of the pickoff magnetic to reduce the magnetic field and thus attraction at the bead removal point.

Magnetic rolls for movement of material are known in other applications in electrophotographic devices, particularly for developing the latent image, as shown in U.S. Pat. No. 4,357,097 to Koiso, U.S. Pat. No. 4,303,331 to Thompson, U.S. Pat. No. 4,461,562 to Goldfinch, DE-OS No. 2364 563, JP No. 56-133761A and JP No. 53-29724, all suggesting magnetic rolls for moving developer material into contact with a charge retentive surface. U.S. Pat. No. 4,705,383 to Hiraga et al shows a magnetic held within a U-shaped housing for the purpose of a doctor blade controlling the size of the bristles formed at a magnetic brush.

SUMMARY OF THE INVENTION

In accordance with the invention there is provided an improved bead removal or pickoff device for removal of carrier beads from a charge retentive surface.

In accordance with one aspect of the invention, a bead pickoff device is supported adjacent to a charge retentive surface, and provided with a stationary magnetic member supported within a rotating nonmagnetic shell. The stationary magnetic member includes a permanent magnet supported in a ferromagnetic channel. The channel is provided with cross-section having at least first and second sides disposed at an angle with respect to one another. A first side is supported with its free end adjacent to the charge retentive surface, while the second side is directed away from the charge retentive surface and supporting the permanent magnet. The stationary magnet member is sized and supported within the rotating shell to leave about 40–60% of the shell empty and arranged so that the empty space is located between the magnet and the bead removal point. The first side is preferably provided with a pointed free end.

Flux from the magnet is concentrated by the ferromagnetic channel in a manner providing a maximum force on carrier beads on the charge retentive surface as they pass the bead pickoff device, attracting beads to the rotating shell. Similarly, the ferromagnetic strip provides a lesser force on the beads held on the shell as it rotates to bring the beads to a removal point. At the removal point, spaced almost 180° from the original pickoff point, the second side of the ferromagnetic strip contains the magnetic flux in a manner effectively shielding the carrier beads from magnetic attraction, to allow the beads to drop off the shell on their own weight. Additionally, the position of the magnet member, away from the removal point increases the distance of the magnet from that point which serves to decrease the magnetic attraction on the beads at the removal point.

The containment of the magnetic flux through the channel minimizes influence of the magnet on the remainder of the developing system, preventing toner bridging between the developing rolls and the bead pickoff device, to allow closer spacing of the device to the developing system. As described herein, the pickoff device may be located within the developer housing. The force removing the beads from the charge retentive surface is maximized adjacent the bead pickoff device for greater removal force, the removal point may be be located almost 180° from the pickoff point, and the single pole geometry is less costly to build than other arrangements. The channel member may be a stamped cold roller steel member for low cost manufacture.

These and other aspects of the invention will become apparent from the following description used to illustrate a preferred embodiment of the invention read in conjunction with the accompanying drawings in which.

Figure 1:
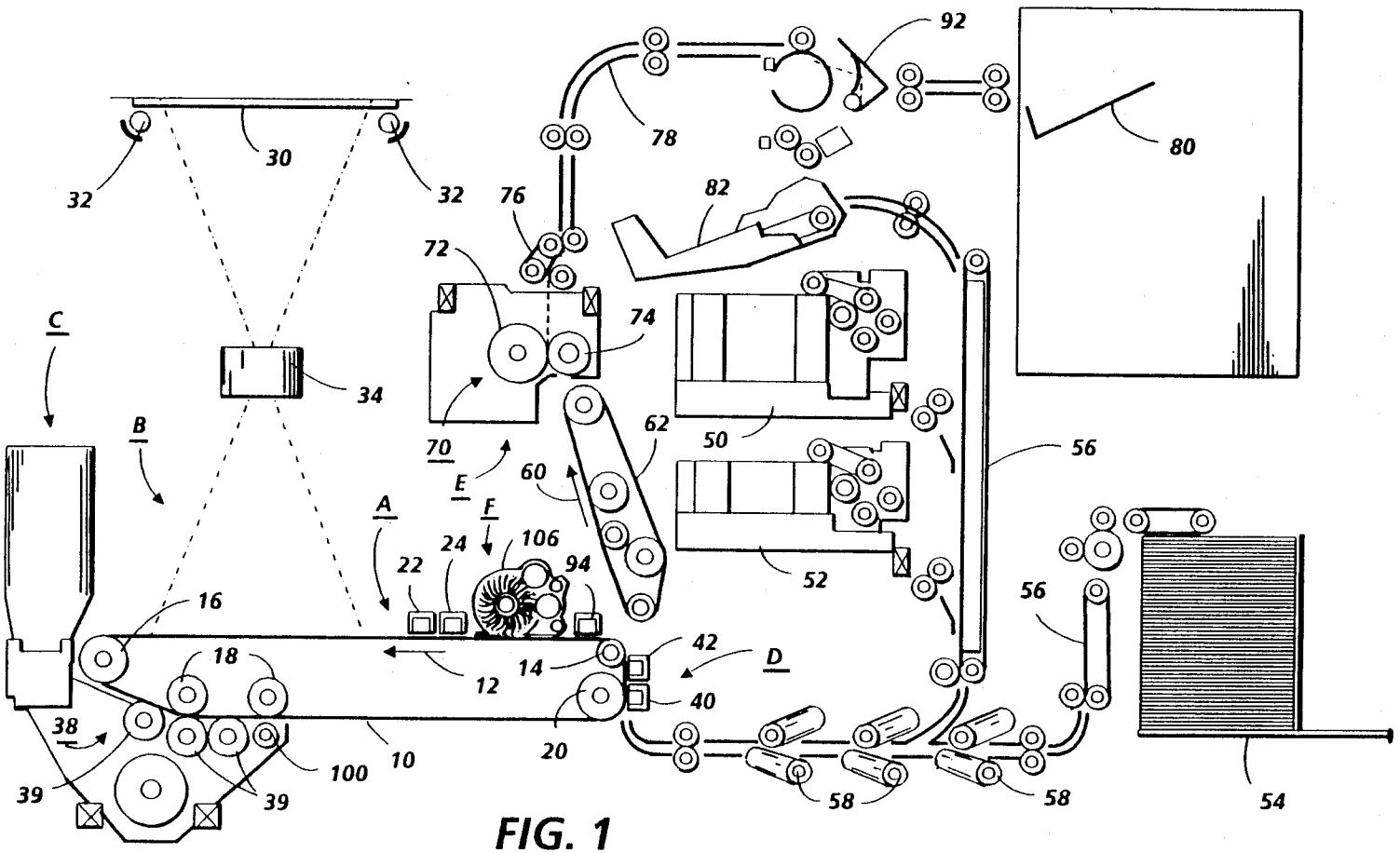
FIG. 1 is a schematic elevational view depicting an electrophotographic printing machine incorporating the present invention.

Referring now to the drawings, where the showings are for the purpose of describing a preferred embodiment of the invention and not for limiting same, the various processing stations employed in the reproduction machine illustrated in FIG. 1 will be described only briefly. It will no doubt be appreciated that the various processing elements also find advantageous use in electrophotographic printing applications from an electronically stored original. Accordingly, a reproduction machine in which the present invention finds advantageous use utilizes a photoreceptor belt 10. Belt 10 moves in the direction of arrow 12 to advance successive portions of the belt sequentially through the various processing stations disposed about the path of movement thereof.

Belt 10 is entrained about stripping roller 14, tension roller 16, idler rollers 18, and drive roller 20. Drive roller 20 is coupled to a motor (not shown) by suitable means such as a belt drive.

Belt 10 is maintained in tension by a pair of springs (not shown) resiliently urging tension roller 16 against belt 10 with the desired spring force. Both stripping roller 18 and tension roller 16 are rotatably mounted. These rollers are idlers which rotate freely as belt 10 moves in the direction of arrow 16.

With continued reference to FIG. 1, initially a portion of belt 10 passes through charging station A. At charging station A, a pair of corona devices 22 and 24 charge photorreceptor belt 10 to a relatively high, substantially uniform negative potential.

At exposure station B, an original document is positioned face down on a transparent platen 30 for illumination with flash lamps 32. Light rays reflected from the original document re reflected through a lens 34 and projected onto a charged portion of photoreceptor belt 10 to selectively dissipate the charge thereon. This records an electrostatic latent image on the belt which corresponds to the information area contained within the original document.

Thereafter, belt 10 advances the electrostatic latent image to development station C. At development station C, a magnetic brush developer unit 38 advances a developer mix (i.e. toner and carrier granules) into contact with the electrostatic latent image with magnetic brushes 39. The latent image attracts toner particles from the carrier granules thereby forming toner powder images on photoreceptor belt 10.

Belt 10 then advances the developed latent image to transfer station D. At transfer station D, a sheet of support material such as paper copy sheet is moved into contact with the developed latent images on belt 10. First, the latent image on belt 10 is exposed to a pre-transfer light from a lamp (not shown) to reduce the attraction between photoreceptor belt 10 and the toner powder image thereon. Next corona generating device 40 charges the copy sheet to the proper potential so that it is tacked to photoreceptor belt 10 and the toner powder image is attracted from photoreceptor belt 10 to the sheet. After transfer, a corona generator 42 charges the copy sheet to an opposite polarity to detack the copy sheet for belt 10, whereupon the sheet is stripped from belt 10 at stripping roller 14.

Sheets of substrate or support material are advanced to transfer station D from supply trays 50, 52 and 54, which may hold different quantities, sizes and types of support materials. Sheets are advanced to transfer station D along conveyor 56 and rollers 58. After transfer, the sheet continues to move in the direction of arrow 60 onto a conveyor 62 which advances the sheet to fusing station E.

Fusing station E includes a fuser assembly, indicated generally by the reference numeral 70, which permanently affixes the transferred toner powder images to the sheets. Preferably, fuser assembly 70 includes a heated fuser roller 72 adapted to be pressure engaged with a back-up roller 74 with the toner powder images contacting fuser roller 72. In this manner, the toner powder image is premanently affixed to the sheet.

After fusing, copy sheets bearing fused images are directed through decurler 76. Chute 78 guides the advancing sheet from decurler 76 to catch tray 80 or a finishing station for binding, stapling, collating etc., and removal from the machine by the operator. Alternatively, the sheet may be advanced to a duplex tray 82 from duplex gate 92 from which it will be returned to the processor and conveyor 56 for receiving second side copy.

A pre-clean corona generating device 94 may be provided for exposing the residual toner and contaminants to positive charges to thereby narrow the charge distribution thereon for more effective removal at rotating electrostatic brush cleaning station F. It is contemplated that residual toner remaining on photoreceptor belt 10 after transfer will be reclaimed and returned to the developer station C by any of several well known reclaim arrangements, and in accordance with the present invention, described below.

As thus described, a reproduction machine in accordance with the present invention may be any of several well known devices. Variations may be expected in specific electrophotographic processing, paper handling and control arrangements without affecting the present invention.

Figure 2:
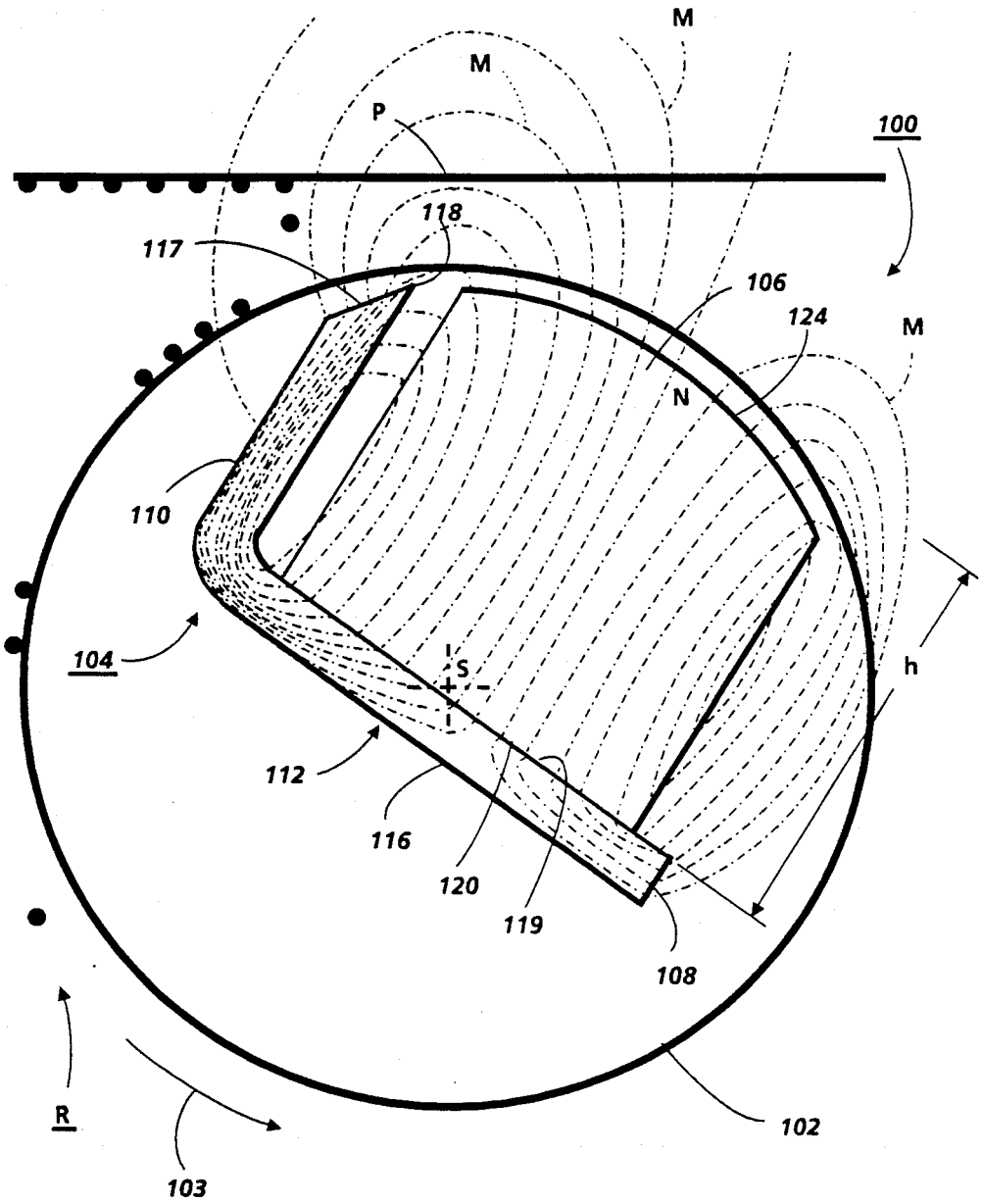
FIG. 2 is a cross-section of a bead pickoff device for use in the machine of FIG. 1.

In accordance with the invention, and with reference to FIGS. 1 and 2, an improved bead pickoff device 100 may be advantageously located within the confines of developer station C, spaced slightly down stream from magnetic brushes 39. With reference now particularly to FIG. 2, bead pickoff device 100 is generally comprised of a cylindrical shell 102 journaled for rotation about a stationary magnet member 104 in the counterclockwise direction, indicated by arrow 103 (as shown in FIG. 2). The direction of shell rotation is not necessarily opposite to the direction of travel of the photoreceptor. Shell 102 may be spaced about 0.1" from photoreceptor belt 10. Both shell 102 and stationary magnetic member 104 extend parallel and across the photoreceptor belt 10, perpendicularly across the direction of travel of photoreceptor belt 10. Shell 102 is non-magnetic material.

Magnetic member 14 includes a permanent magnet 106, having a generally rectangular cross-section, seated in a ferromagnetic strip or channel 108, having at least first and second sides 110 and 112 disposed at an angle in the range of approximately 70°–110° with respect to each other. Channel 108 may be conveniently stamped from 3/32" or 1/16" cold rolled steel or the like, which has a desirable high saturation magnetization, for a particularly economic fabrication. As noted, the angle between the sides may vary somewhat from 90°, and while an improvement in bead pickoff from the photoreceptor is noted at more acute angles, to about 70°, there is a greater difficulty and expense in manufacturing the channel. A variety of permanent magnetic material may be used for magnet 106, including ceramic and rubber magnets. The magnet is retained in the channel by epoxy or a similar adhesive.

Second side 112 is provided with a flat exterior surface 116. It has been found desirable to have the uppermost surface 117 of first side 110 located as closely adjacent to the photoreceptor as the structure will allow. An angled or sharp tip 118 formed on the free end of first side 110 appears to provide an optimum geometry to obtain this desirable arrangement. Permanent magnet 106 is seated on interior surface 119 of second side 112, spaced a selected distance from first side 110, with magnet base 120 flush against interior surface 119. The gap between magnet 106 and channel side 110 is selected to produce a maximum attractive force, approximately equal to the distance of the photoreceptor above magnet 106 and side 110. The optimum gap is then found by calculation of force for a range of gaps around the approximation. Magnet cross-sectional height h, from magnet base 120 to magnet top surface 124, may be generally coextensive with long side 110, or slightly longer. The magnetic cross-sectional width w is selected such that it may be seated on the interior surface 119 with the selected clearance from side 110 and spaced from the free end of side 112. North and south poles of the magnet are arranged along an axis from top 124 to base 120. Nonrectangular cross-sections for the permanent magnet 106 may be used, including, for example, a generally rectangular cross-section with the corners of magnet base 120 adjacent interior surface 119 cut out. The magnet top surface may conform to the arc of shell 102 to provide a constant spacing between the magnet and shell.

Magnetic member 104 is arranged within shell 102 so that it is spaced from the carrier bead removal point, generally indicated as R. Magnetic member 104 is sized so that it takes up only approximately 40–60% of the space within shell 102, with the remaining space between the member and the drop off point.

Carrier beads, indicated in FIG. 2 by small circles on the upstream side of the bead pickoff device, adhere to photoreceptor belt 10 and are carried towards bead pickoff device 100, where they are attracted from photoreceptor belt 10 towards magnet member 104 by the strong concentration of magnetic flux at the point P caused by the configuration of the channel side 110 in combination with magnet 106. Magnetic flux or the magnetic field is directed through the ferromagnetic channel 108, and as shown by the field lines M of FIG. 2, is concentrated at the air gap between sharp tip 118 and magnet top 124. Force on the beads is directed approximately perpendicularly to the field lines. generally from point P towards shell 102 and is given by $$F \sim (\bar{B} \cdot \nabla)\bar{B}$$

where B is the magnetic field vector and $\nabla$ is the gradient operator. The actual values of the magnetic field are calculated by a numerical method.

Beads attracted to the magnet are held on shell 102, and carried away from point P by rotation of the shell. Beads on the shell are retained thereon through rotation away from photoreceptor belt 10 by a decreasing magnetic force. As the bead on the shell is carried away from the photoreceptor, the ferromagnetic strip contains the magnetic flux in a manner effectively shielding the carrier beads from magnetic attraction, and allowing the beads to drop off the shell at about point R under their own weight. A blade or other arrangement might also be provided for removal of beads from shell 102. The flat exterior surface of side 112 serves to concentrate the flux into a more compact area to create a greater drop off of the magnetic field at the removal point. The exterior corner of the channel may be rounded or blunted to the same purpose.

The empty space between the shell 102 and the magnetic member 104 serves to allow attenuation of the magnetic field as the field intensity decreases inversely with distance from the magnet.

Figure 3:
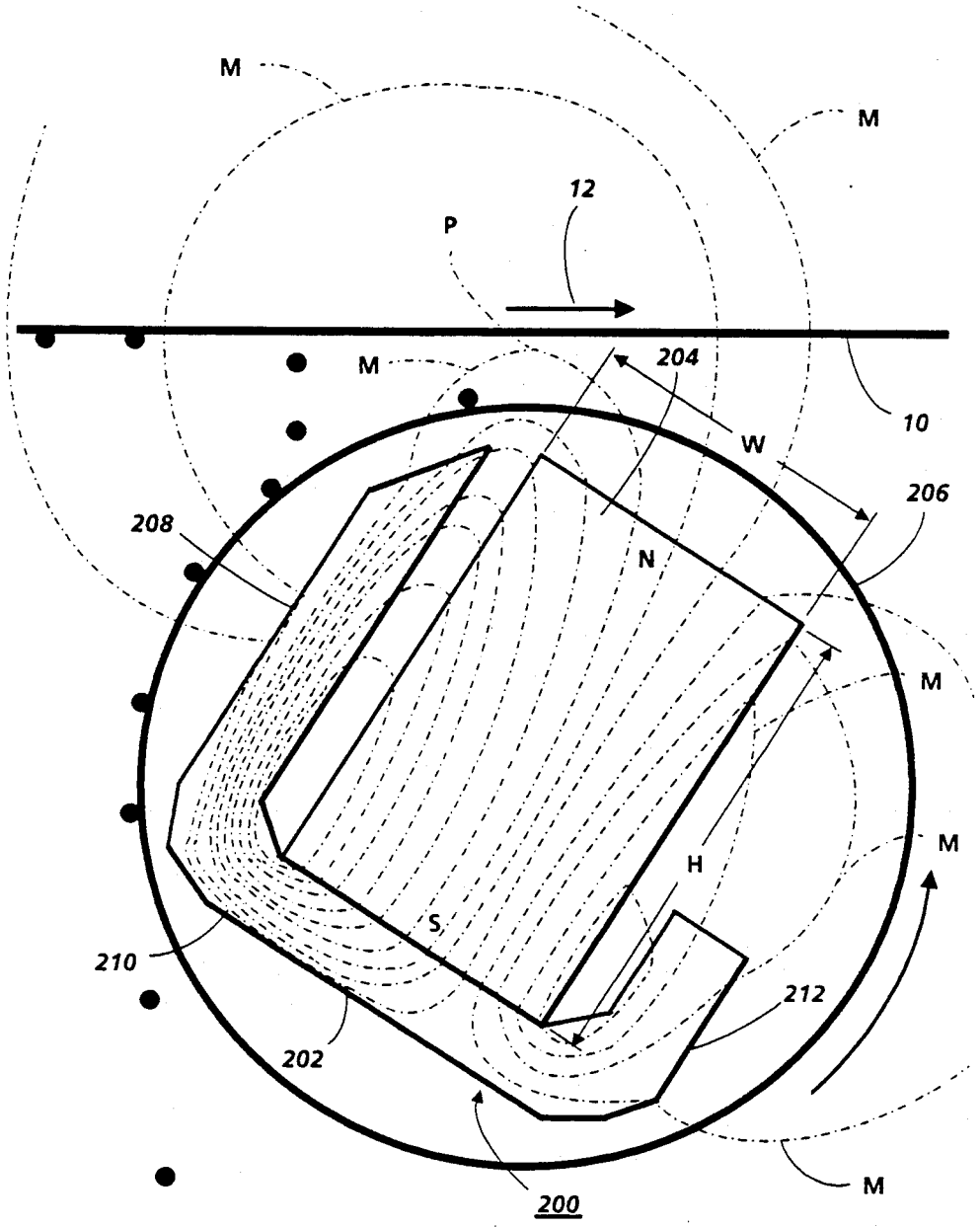
FIG. 3 is a cross-section of an alternative embodiment of the invention.

FIG. 3 demonstrates a similar and alternative embodiment with a magnetic member 200 including a generally U-shaped channel 202 supporting a permanent magnet 204 within a rotating shell 206. U-shaped channel 202 is provided with a long first side 208, extending towards the photoreceptor with a pointed free end, a second connecting side 210 arranged approximately perpendicularly to first side 208 with an allowable range of variations as described for the previous embodiment, and third shorter side 212 arranged generally perpendicularly to second side 210 and generally parallel to first side 208. Permanent magnet 204 is seated between and spaced from either first and third sides. Spacing of the first side is dependent on the distance to the photoresistor from the long side. In this case, the magnetic member is shown taking up a substantially greater portion of the space within the shell, but as with the embodiment shown in FIG. 2, the magnetic member may be sized to take up between 40–60% of the shell, and spaced from removal point R, with empty space between the magnet member and the removal point. The second arm 212 has the tendency to diffuse the magnetic field and force on the opposite side of the magnet.

The arrangement may provide for the carrier beads to fall to the developer material sump or a waste container for eventual removal. Of course, it will no doubt be appreciated that the bead pickoff could be located remote from the developer station, and before the transfer station.

The invention has been described with reference to a preferred embodiment. Obviously modifications will occur to others upon reading and understanding the specification taken together with the drawings. This embodiment is but one example, and various alternatives modifications, variations or improvements may be made by those skilled in the art from this teaching which are intended to be encompassed by the following claims.

We claim:

1. Reproduction apparatus including a charge retentive surface; an image forming station; a developing station developing the latent image with a toner and carrier bead mix; a transfer station; and a carrier bead removal device removing carrier beads adhering to the charge retentive surface after development, including a non-magnetic bead supporting all supported for rotation closely adjacent to the charge retentive surface for receiving removed carrier beads and transporting the beads to a removal point and a magnetic member supported within the shell and providing a magnetic force for attraction of the beads from the charge retentive surface to the shell, said magnetic member comprising:

a magnet, a ferromagnetic channel having a cross-section with first and second sides, disposed at an angle with respect to each other, said first side having a free end generally extending towards said the charge retentive surface; and said magnet stated on said second side and spaced from said first side.

2. Reproduction apparatus as defined in claim 1 wherein the uppermost surface of said free end of said first side is arranged closely adjacent to said charge retentive surface.

3. Reproduction apparatus as defined in claim 2 wherein the said free end of said first side provided with an angled point to bring said uppermost surface into closely adjacent relationship to said charge retentive surface.

4. Reproduction apparatus as defined in claim 1 wherein the angle between said first and second sides is between 70° and 110°.

5. Reproduction apparatus as defined in claim 1 wherein said magnet has a generally rectangular cross-section, with a side approximately parallel and generally coextensive with said first side.

6. Reproduction apparatus as defined in claim 5 wherein said magnet has a surface adjacent and generally conforming to said shell.

7. Reproduction apparatus defined in claim 1 wherein said spacing between said magnet and said first side is selected to be approximately equal to the distance of the charge retentive surface from the magnet and the first side.

8. Reproduction apparatus as defined in claim 1 wherein said magnet member is sized and supported within said shell with a spacing between the magnet member and the shell at the removal point allowing attenuation of magnetic force of attraction on said beads thereat.

9. Reproduction apparatus as defined in claim 8 wherein said magnet member is sized to fit into a space of about 40–60% of the cross sectional area of the shell.

10. Apparatus for forming a latent image on a charge retentive surface and developing the latent image with a carrier bead and toner mixture within a developer housing for subsequent transfer to a substrate, including means for removing carrier beads adhering to the charge retentive surface prior to transfer, said carrier bead removal means comprising:

a non-magnetic shell journaled for rotation closely adjacent to the charge retentive surface;

a stationary magnet member, supported within said shell;

said magnet member including a permanent magnet and a ferromagnetic channel having a generally L-shaped cross-section with first and second sides, said first side generally extending towards the charge retentive surface;

said magnet seated on said second side, spaced from said first side with a magnetic pole generally arranged adjacent the charge retentive surface;

said magnet and said first side concentrating the attractive force of said magnet at a point adjacent the charge retentive surface for removal of said carrier beads from the charge retentive surface to the rotating shell; and said magnet member sized and supported within said shell with a spacing between the magnet member and the shell at a removal point, allowing attenuation of magnetic force of attraction on said beads thereat.

11. Apparatus as defined in claim 10 wherein the free end of said first side is generally a sharp point extending towards the charge retentive surface.

12. Apparatus as defined in claim 10 wherein said carrier bead removal means is located within said developer housing.

13. Reproduction apparatus as defined in claim 10 wherein said spacing between said magnet and said first side is selected to be approximately equal to the distance of the charge retentive surface from the magnet and the first side.

14. Reproduction apparatus as defined in claim 10 wherein said magnet member is sized to fit into a space of about 40–60% of the cross sectional area of said shell.

15. Reproduction apparatus including a charge retentive surface; an image forming station; a developing station developing the latent image with a toner and carrier bead mix; a transfer station; and a carrier bead removal device removing carrier beads adhering to the charge retentive surface after development, including a non-magnetic bead supporting shell supported for rotation closely adjacent to the charge retentive surface for receiving removed carrier beads and transporting the beads to a removal point and a magnetic member supported within the shell and providing a magnetic force for attraction of the beads from the charge retentive surface of the shell, said magnetic member comprising:

a magnet;

a ferromagnetic channel having first, second and third sides, generally formed a U-shaped cross section, with first and third sides generally parallel and with the second side connecting said first and third sides thereinbetween;

said magnet seated on said second side, spaced from said first side.

16. Reproduction apparatus as defined in claim 15 wherein the free end of said first side is provided with a sharp point extending towards the charge retentive surface.

17. Reproduction apparatus as defined in claim 15 wherein the angle between said first and second sides is between 70° and 110°.

18. Reproduction apparatus as defined in claim 15 wherein said spacing between said magnet and said first side is selected to be approximately equal to the distance of the charge retentive surface from the magnet and the first side.

19. Reproduction apparatus as defined in claim 15 wherein said magnet member is sized and supported within said shell with a spacing between the magnet member and the shell at the removal point allowing attentuation of magnetic force of attraction on said beads thereat.

20. Reproduction apparatus as defined in claim 19 wherein said magnet member is sized to fit into a space of about 40–60% of the cross sectional area of the shell.

* * * * *

UNITED STATES PATENT AND TRADEMARK OFFICE
CERTIFICATE OF CORRECTION

PATENT NO. : 4,829,338

DATED : May 9, 1989

INVENTOR(S) : Gary L. Whittaker and Daniel M. Bray

It is certified that error appears in the above-identified patent and that said Letters Patent is hereby corrected as shown below:

Column 7, Claim 1, line 16, delete "stated" and insert --seated--.

Signed and Sealed this

Third Day of October, 1989

*Attest:*

DONALD J. QUIGG

*Attesting Officer*

*Commissioner of Patents and Trademarks*